United States Patent [19]

Ebihara

[11] Patent Number: 4,487,099

[45] Date of Patent: Dec. 11, 1984

[54] ELECTRO-ACOUSTIC TRANSDUCER DRIVE CIRCUIT FOR PRODUCING DAMPED WAVEFORM ENVELOPE MUSICAL NOTES

[75] Inventor: Heihachiro Ebihara, Tanashi, Japan

[73] Assignee: Citizen Watch Company Limited, Tokyo, Japan

[21] Appl. No.: 518,234

[22] Filed: Jul. 28, 1983

[30] Foreign Application Priority Data

Jul. 30, 1982 [JP] Japan ..... 57-133205
Jul. 30, 1982 [JP] Japan ..... 57-133203

[51] Int. Cl.[3] ..... G10H 1/02
[52] U.S. Cl. ..... 84/1.26; 368/255
[58] Field of Search ..... 310/317; 84/1.13, 1.26; 179/110 A; 381/111, 114; 340/384 E; 368/255; 367/157, 167

[56] References Cited

U.S. PATENT DOCUMENTS 4,068,461 1/1978 Fassett et al. ..... 368/73
4,078,187 3/1978 Kanisawa et al. ..... 310/339

FOREIGN PATENT DOCUMENTS 53-84766 7/1978 Japan ..... 368/255
56-79987 6/1981 Japan ..... 368/255
57-76471 5/1982 Japan ..... 368/255
2098763 11/1982 United Kingdom ..... 368/255

*Primary Examiner*—Forester W. Isen
*Attorney, Agent, or Firm*—Jordan and Hamburg

[57] ABSTRACT

An electro-acoustic transducer drive circuit for driving a device such as a miniature piezoelectric buzzer to emit musical notes, the notes having a damped waveform envelope whose shape is controlled by digital signals. The notes are formed by mutually independent circuit means and can be combined to produce musical chords. The circuit incorporates relatively few elements, and is suitable for implementation within a MOS IC.

15 Claims, 27 Drawing Figures

ELECTRO-ACOUSTIC TRANSDUCER DRIVE CIRCUIT FOR PRODUCING DAMPED WAVEFORM ENVELOPE MUSICAL NOTES

BACKGROUND OF THE INVENTION

The present invention has the objective of providing an electro-acoustic transducer drive circuit suitable for driving a transducer such as a miniature piezoelectric buzzer to emit musical notes, each note having a damped waveform envelope (i.e. decaying gradually from an initial peak amplitude), and provides the capability for producing a plurality of such notes of different frequencies mutually superimposed to form musical chords.

In the prior art there have been various proposals for drive circuit means for producing sounds resembling musical tones or notes from devices such as the miniature piezoelectric buzzer commonly used in miniature electronic devices such as electronic wristwatches. However for various reasons which will be described in detail hereinafter with reference to prior art embodiments of such circuits, it has not been found possible with such prior art circuits to provide more than a very limited range of output acoustic frequencies. In addition, a relatively large number of circuit elements are generally required to form a tone or note of a specific frequency. Due to these considerations, it has not been possible to form a drive circuit suitable for the production of musical chords (i.e. mutually superimposed musical notes or tones) which is capable of being incorporated within an integrated circuit chip such as is in widespread use at present in miniature electronic devices such as electronic wristwatches, and in particular within a MOS transistor type of integrated circuit.

The present invention discloses a drive circuit which overcomes the disadvantages of such prior art circuits, being fully capable of implementation by a relatively small number of elements which can readily be provided within a MOS IC chip, with the frequency and envelope shape of each note produced being determined by digital signals which can be readily derived from the timebase signal generating circuit and frequency divider circuits generally utilized in a miniature electronic device such as an electronic wristwatch, and providing the capability of combining any number of musical notes of different frequencies to form musical chords.

SUMMARY OF THE DISCLOSURE

An electro-acoustic transducer drive circuit according to the present invention basically comprises a voltage step-up circuit coupled to a power source such as a battery to produce a stepped-up potential, a drive input signal generating circuit for producing drive input signals comprising bursts of pulses each having a damped waveform envelope and a frequency corresponding to a musical note designated by note setting means, and drive circuit means operating from the stepped-up potential as a power supply voltage and responsive to the drive input signals for generating corresponding drive signals of relatively high voltage amplitude for driving an electro-acoustic transducer to produce musical notes or (when a plurality of the bursts of pulses described above are generated mutually overlapping in time) musical chords. The drive input signals are output from a common output terminal of a plurality of envelope circuits, each of which acts to shape the waveform envelope of a specific note and output a corresponding burst of damped pulses when emission of that note is specified by the selection means.

The shaping of the waveform envelope by an envelope cell is performed by digital signals which control the conductance of an MOS transistor to successively vary such as to successively attenuate the peak value of the output signal from that envelope cell. Although this is a stepwise type of successive attenuation, a sufficient number of steps can be readily provided such that an impression of a smoothly damped waveform envelope is given by the emitted sound, with the envelope being similar to that of certain musical instruments, i.e. having an initially rapid rate of decay from a peak amplitude, and a subsequent increasingly gradual rate of decay. Thus, a very pleasing sound can be produced utilizing such a circuit.

DESCRIPTION OF THE PREFERRED EMBODIMENTS

Figure 1:
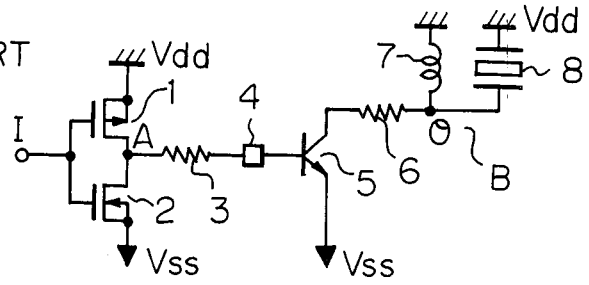
Fig. 1 PRIOR ART
FIG. 1 is an example of a circuit diagram of an electro-acoustic transducer drive circuit according to the prior art.

Before describing embodiments of the present invention, prior art electro-acoustic drive circuits will be described with reference to the drawings. FIG. 1 shows an example of a prior art type of electro-acoustic transducer drive circuit utilized in a timepiece, for driving an electro-acoustic transducer which will be assumed to be a piezoelectric (i.e. voltage-driven) type of buzzer. The circuit operates from a DC power supply producing high and low power supply potentials Vdd and Vss respectively. The output terminal A of a gate circuit comprising a P-channel MOST (hereinafter abbreviated to MOS transistor) 1, and an N-channel MOST 2 is coupled to an external terminal 4 through a resistor 3. The base of a bipolar transistor 5 provided external to the integrated circuit is coupled to external terminal 4. The emitter of bipolar transistor 5 is coupled to the low potential Vss of a power supply, while the collector is coupled to one terminal of a resistor 6, with the other terminal of resistor 6 being connected through a coil 7 and a piezoelectric buzzer 8 to the high potential Vdd of the power supply.

Figure 2:
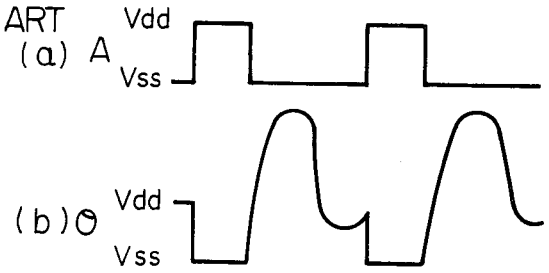
Fig. 2 PRIOR ART
FIG. 2 is a waveform diagram of the circuit of FIG. 1.

A signal comprising a pulse train having a frequency corresponding to a musical tone is applied to the input terminal I of this gate circuit, and an inverted signal waveform shown in FIG. 2(a) is output from terminal A. When terminal A is at the Vdd potential, bipolar transistor 5 is set in the conducting state, so that current flows through coil 7. Since output terminal A thereby goes to the Vss potential, bipolar transistor 5 is set in the non-conducting state, so that the current which is flowing in coil 7 becomes interrupted to thereby produce a reverse EMF which appears at output terminal O. The piezoelectric buzzer 8 presents a capacitative load to this induced voltage, whereby a voltage having the waveform shown in FIG. 2(b) appears at output terminal O. The peak value of this voltage waveform is of the order of 6 V, i.e. coil 7 is used to perform voltage step-up.

A first disadvantage of such a prior art circuit is that the frequency range for which it can be employed is rather narrow. In other words, the waveform appearing at output terminal A shown in FIG. 2 cannot be freely selected, with the frequency and duty ratio being restricted. While the potential of output terminal A is at the Vdd level, the current which flows in coil 7 gradually increases at a rate determined by the coil inductance. This is due to the fact that the amplitude of the back EMF voltage which is produced when the coil current is interrupted will depend on the amplitude of the current flowing at the instant of interruption, so that it is necessary to ensure that the current flow is continued until it reaches a sufficiently high level to ensure a desired value of sound volume output from piezoelectric buzzer 8. Thus, the minimum value of each of the time intervals during which output terminal A is at the Vdd potential is restricted.

Thus, the minimum value of each time interval for which output terminal A should be at the Vss potential is determined by the time required for the waveform of the voltage appearing at output terminal O to reach its maximum value, while the maximum value of such a time interval is determined by the fact that if the repetition frequency of the signal appearing on output terminal A differs too greatly from the natural frequency of resonance of the piezoelectric buzzer, then no sound output will be produced, i.e. the drive signal frequency must be within a range which is close to that natural resonance frequency. In addition, the maximum duration of each interval for which output terminal A is at the Vdd potential is limited by considerations of power consumption.

As a result of these restrictions on the voltage waveform of the signal appearing on output terminal A, the frequency range for acoustic emission is very limited.

A second disadvantage of such a prior art circuit is based upon the first disadvantage described above, namely that it is difficult to produce musical chords. This is due to the very restricted frequency range available with such a circuit, as described above, and also due to the fact that the number of circuit elements required becomes excessive, if arbitrary combinations of tones of different frequencies are to be produced independently and superimposed to produce musical chords.

Figure 3:
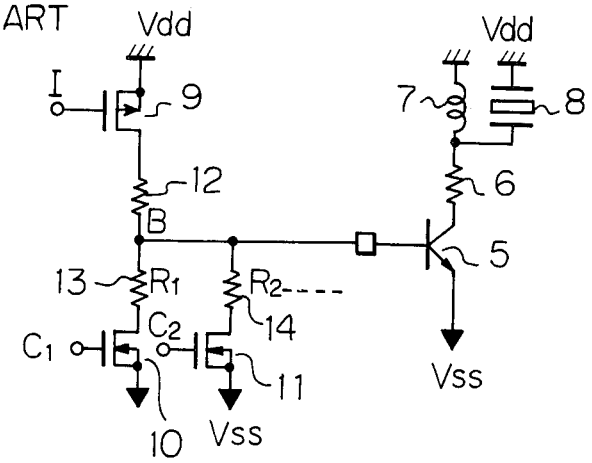
Fig. 3 PRIOR ART
FIG. 3 is a circuit diagram of another example of a prior art electro-acoustic transducer drive circuit.

FIG. 3 shows an example of a prior art type of circuit to be implemented within an integrated circuit, for producing damped (i.e. having a gradually attenuated acoustic waveform envelope) single notes. Here, the drain electrode of a P-channel MOST 9 is connected through a resistor 12 to the base of a bipolar transistor 5, with the junction point being designated as B.

A plurality of resistors R1 13, R2 14, . . . are connected from this junction point B through N-channel MOSTs 10, 11, . . . respectively, to the Vss potential. The gate terminals C1, C2 of N-channel MOSTs 10, 11, are coupled to receive specific combinations of signals. When P-channel MOST 9 is set in the conducting state, the potential appearing at junction point B is determined by a resistive voltage divider made up of the resistor 12 and the effective resistance value of the parallel-connected resistors R1, R2, . . . .

Thus, the voltage that is applied to gate terminals C1, C2, change with time, and the peak voltage appearing at junction point B is gradually reduced accordingly, so that the current which flows in coil 7 is gradually decreased, and the volume of sound produced by buzzer 8 is gradually reduced.

Such a method is simple. However, if the number of resistive voltage divider combinations is not made sufficiently large, the envelope of the damped sound output will have a stepwise shape, leading to an unnatural type of sound. Conversely, as the number of resistive voltage divider combinations is increased, it becomes increasingly difficult to implement the circuitry within an integrated circuit. In addition to these points, it is necessary to provide a control signal generating circuit, in order to produce signals for controlling the resistive voltage divider ratio, so that the circuitry becomes complex.

Figure 4:
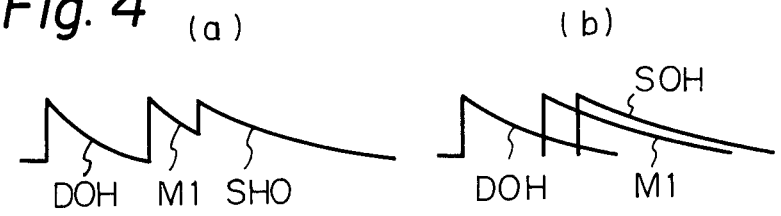
FIG. 4 shows diagrams illustrating the waveform envelopes of damped musical notes, for the case of the notes being produced successively and separately and the case of the notes being superimposed to form musical chords, respectively.

Thus, the circuit of FIG. 3 can be used to provide single acoustic note envelopes, such as are shown in FIG. 4. However in order to produce a number of independent waveform envelopes which can be mutually superimposed, such as to produce musical chords each made up of a plurality of mutually superimposed musical notes of different frequencies and each having a damped (i.e. gradually decreasing from an initial maximum value) as shown in FIG. 4b, it is necessary with such a prior art method to provide a number of such envelope circuits, making it difficult to put such a system into practical application.

An embodiment of the present invention to overcome the above problems which arise with prior art methods will now be described.

Figure 5:
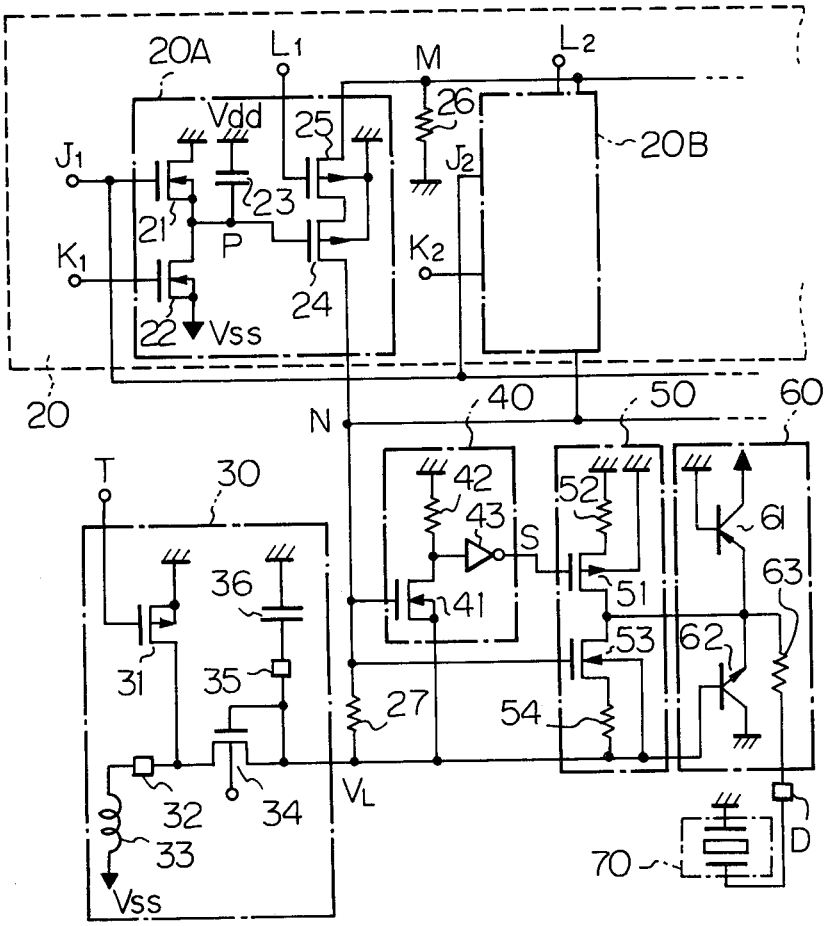
FIG. 5 is a circuit diagram showing the essential elements of an embodiment of an electro-acoustic transducer drive circuit according to the present invention.

Referring first to FIG. 5, a circuit diagram of the important elements of an embodiment of the present invention is shown. The configuration can be broadly divided into a plurality of envelope cells 20A, 20B, . . . , a voltage step-up circuit 30, a level sensing circuit 40, a drive circuit 50, and a protective circuit 50. A DC power source such as a battery (not shown in FIG. 5) produces a high power supply potential, designated herein as Vdd, and a low (i.e. negative) power supply potential, designated herein as Vss.

The configuration of envelope cell 20A will first be described. This comprises an N-channel MOST 21 having the gate electrode connected to the Vdd potential, the source electrode and substrate connected to the ddrain electrode of an N-channel MOST 22 and also connected through a capacitor 23 to the Vdd potential and moreover connected to the gate electrode of a P-channel MOST 24. The gate electrode of N-channel MOST 21 is connected to a common input terminal J1. The gate electrode of N-channel MOST 22 is connected to an individual input terminal K1, while the source electrode and substrate are connected to the Vss potential. The source electrode of P-channel MOST 24 is connected to the drain electrode of P-channel MOST 25, while the drain electrode of P-channel MOST 24 is connected to the common output terminal N, and the substrate is connected to the Vdd potential. In this embodiment, the Vdd potential is ground potential. The gate electrode of P-channel MOST 25 is connected to an individual input terminal L1, while the source electrode is connected to a common output terminal M and the substrate is connected to the Vdd (i.e. ground) potential.

The common input terminal J1 is coupled to receive a narrow spike waveform signal comprising a train of pulses having narrow and precisely defined pulse width, produced by a spike waveform signal generating circuit (described hereinafter). The individual input terminals L1, L2, . . . are respectively coupled to receive different tone signals (i.e. pulse train signals at frequencies corresponding to different musical tones), while sound generating signals comprising pulses which act to initiate generation of a note are applied to the individual input terminals K1, K2, . . . . The common terminal M is coupled through a resistor 26 to the Vdd potential, while common output terminal N is connected through a resistor 27 to the stepped-up potential from voltage step-up circuit 30, and also to the level sensing circuit 40 and to drive circuit 50.

The stepped-up potential produced by voltage step-up circuit 30, designated in the following as potential VL, is negative with respect to Vss, i.e. the potential difference between Vdd and VL is greater than the potential difference between Vdd and Vss.

Figure 6:
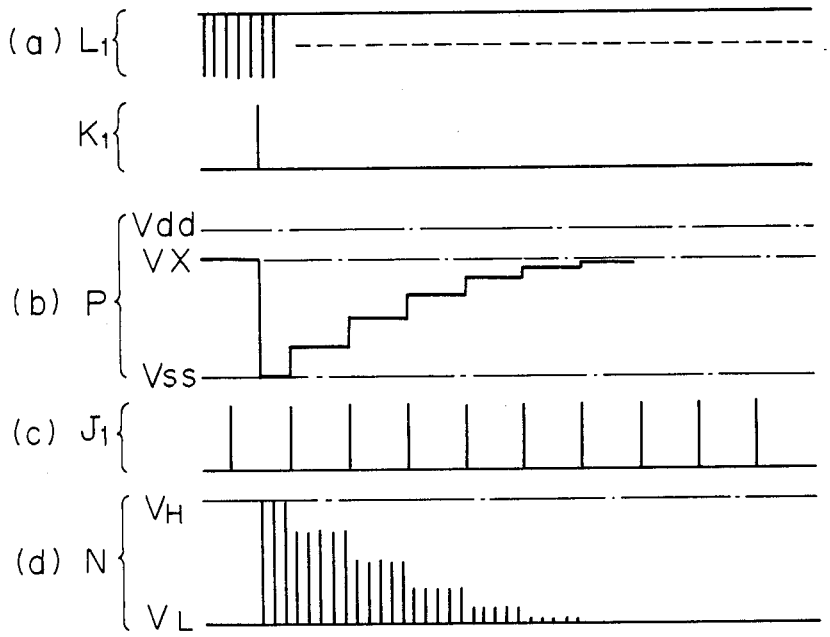
FIG. 6 is a waveform diagram for illustrating the operation of the circuit of FIG. 5.

FIG. 6 is a waveform diagram for illustrating the operation of an envelope cell, with the signals for envelope cell 20A being shown by way of example. A tone signal shown in FIG. 6(*a*) is applied to the individual input terminal, e.g. L1. Normally, a high potential Vx is applied to gate terminal P of P-channel MOST 24 as shown in FIG. 6(*b*), so that transistor 24 is held in the non-conducting state, whereby output terminal N is held at the stepped-up potential VL of voltage step-up circuit 30.

FIG. 6(*c*) and 6(*d*) show the signal waveforms which appear at input terminal J1 and common output terminal N, respectively. When a sound generation signal comprising a positive-going pulse generated at some arbitrary time is applied to individual input terminal K1, then that terminal is raised to the Vdd level during a short time interval, and during that time the N-channel MOST 22 is set in the conducting state. As a result, gate terminal P goes to the Vss potential during that time interval. Because of this, P-channel MOST 24 goes to the conducting state, and the tone signal appears on output terminal N. Subsequently, each succeeding pulse of the spike waveform pulse signal applied to terminal J1 acts to set N-channel MOST 21 set in the conducting state during a short time interval. As a result, part of the charge in capacitor 23 is discharged during each of these successively occurring time intervals, whereby the potential of gate terminal P rises in successive steps towards the Vdd potential.

Due to this, the conducting state resistance of P-channel MOST 24 becomes higher in successive incremental steps, so that the peak value of the tone signal appearing at output terminal N becomes correspondingly attenuated. Since the source electrode of N-channel MOST 21 is connected to the gate terminal P, as the potential of gate terminal P rises, the change in conductance of N-channel MOST 21 resulting from successive spike waveform pulses becomes gradually reduced. Accordingly, the amount of charge that is successively discharged from capacitor 23 by successive spike waveform signal pulses becomes gradually reduced. This results in an increasingly gradual rate of reduction of the peak amplitude of the tone signal which appears on common output terminal N, as time elapses. After a certain time has elapsed, the potential of gate terminal P will have fallen from the Vdd level to the threshold potential of N-channel MOST 21. If N-channel MOST 21 and P-channel MOST 24 have a substantially identical threshold potential, then when this occurs, P-channel MOST 24 will be set substantially close to the non-conducting state, so that no tone signal will appear on output terminal N.

Thus, since the potential of gate terminal P approaches the threshold potential of P-channel MOST 24 in a very gradual manner, damping of the sound output is extremely natural, without the sudden stepwise reductions in the sound which occur with prior art types of built-in damping sound generating circuits. In addition, the changes in potential of gate terminal P depend upon the width of the gate signal pulses, the value of capacitor 23, and the conductance of N-channel MOST 21, as well as the period of the spike waveform signal. Thus, by suitably selecting these parameters, it is possible to implement very smooth damping of the output sound envelope, with almost no sensation of stepwise reductions in sound volume. It can also be understood that a circuit according to the present invention does not require any substantial increase in the number of circuit elements required, by comparison with the prior art.

As shown in FIG. 6(*d*), the waveform appearing at output terminal N varies between a positive potential level which is designated as VH and the VL potential from voltage-step-up circuit 30. The value of VH is determined by the conducting resistance of P-channel MOSTs 24 and 25, the value of resistor 26, and the value of resistor 27.

In FIG. 5, drive circuit 50 comprises a P-channel MOST 51 having the source electrode connected through a resistor 52 to the Vdd potential, and an N-channel MOST 53 having the drain electrode connected in common with that of P-channel MOST 51 and the source electrode connected through a resistor 54 to the stepped-up VL of voltage step-up circuit 30. The gate electrode of N-channel MOST 53 is connected to the output terminal N of envelope cells 20A, 20B, . . . , while the drain electrode is connected through an external terminal 64 to electro-acoustic transducer 70. A signal having a damped waveform envelope appears on output terminal N of the envelope cells 20A, 20B, . . . , and since the conductance of N-channel MOST 53 varies in accordance with the peak value of that signal, corresponding changes take place in the value of current flowing in electro-acoustic transducer 70. Thus, a sound output having a damped waveform envelope is emitted.

If the electro-acoustic transducer 70 is of current drive type, then the circuit can be configured basically as described above, with no particular modifications being necessary. However if electro-acoustic transducer 70 is a piezoelectric buzzer, and so presents a capacitative load, then a discharge circuit will be necessary in order to discharge that capacitance. In FIG. 5, P-channel MOST 51 serves as a discharge transistor for this purpose. When N-channel MOST 53 is almost in the non-conducting state, P-channel MOST 51 enters the conducting state whereby the terminals of electro-acoustic transducer 70 become short-circuited. In this case, it is necessary to sense the degree to which N-channel MOST 53 is in the conducting state, and this function is performed by level sensing circuit 40.

The configuration of level sensing circuit 40 will now be described. This comprises a N-channel MOST 41 having the source electrode and substrate connected to the output terminal VL of voltage step-up circuit 30 and a gate electrode connected to the common output terminal N of the envelope cells 20A, 20B, . . . , and having the drain electrode connected through a resistor 42 to the Vdd potential and also to the input terminal of an inverter 43. The output terminal of inverter 43 comprises the output terminal S of level sensing circuit 40, which is connected to the gate electrode of MOST 51.

Since N-channel MOST 41 of level-sensing circuit 40 and N-channel MOST 53 of drive circuit 50 are formed within the same IC chip, their electrical characteristics can be made closely similar. Thus, when N-channel MOST 53 is almost in the non-conducting state, the output signal from inverter 43 will be inverted to go to the Vss level, with the precise level at which this occurs being set by the value of resistor 42 and the conductance of N-channel MOST 41.

Figure 7:
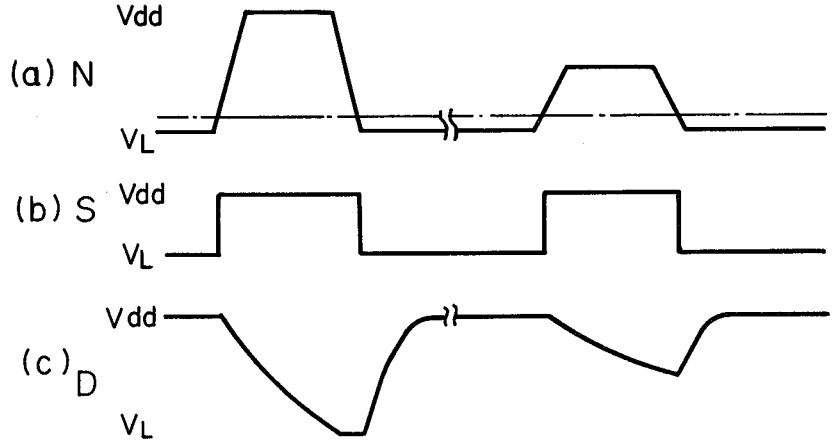
FIG. 7 is a waveform diagram for illustrating the operation of a level sensing circuit in FIG. 5.

FIGS. 7(*a*), (*b*) and (*c*) respectively show the waveform of the signal appearing on common output terminal N of envelope cell 20A, the signal waveform appearing on output terminal S of level sensing circuit 40, and the waveform of signal D appearing on external terminal 64, for the case in which electro-acoustic transducer 70 comprises a piezoelectric buzzer, with the peak-to-peak swing of output drive signal D being from Vdd to the VL potential. It can be seen that the output produced from level sensor 40 acts to set MOST 51 in the non-conductive state at the instance when the drive input signal from common terminal N sets MOST 53 in the conducting state, and vice-versa.

Protective circuit 60 must be sufficiently effective to prevent the occurrence of abnormal operation such as latch-up of the integrated circuit, resulting from high voltages being produced by the application of mechanical shock to the piezoelectric buzzer, as described previously. With the present invention, a diode type of protective circuit such as is employed in the prior art is not utilized. Instead, a transistor type of circuit is employed.

Figure 8A:
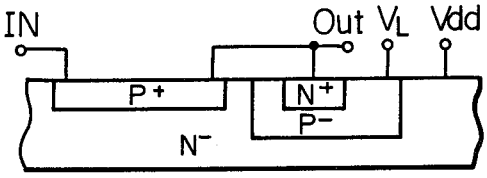
FIG. 8(*a*) and 8(*b*) are diagrams illustrating the physical configuration and the equivalent circuit, respectively, of a prior art protective circuit.
Figure 8B:
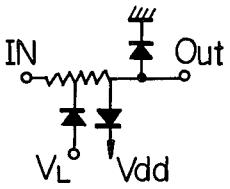
Figure 9A:
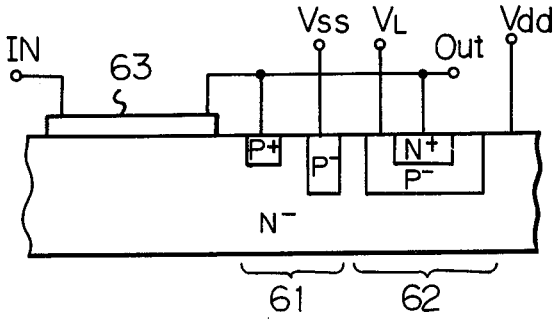
FIG. 9(*a*) and 9(*b*) are diagrams illustrating the physical configuration and the equivalent circuit, respectively, of a protective circuit according to the present invention.
Figure 9B:
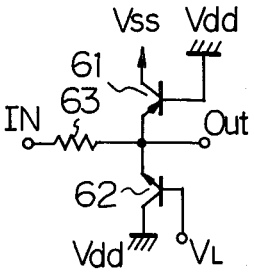

FIGS. 8(*a*) and 8(*b*) are respectively a diagram showing the configuration of a prior art protective circuit and its equivalent circuit. FIGS. 9(*a*) and 9(*b*) respectively show the configuration of a protective circuit according to the present invention, and its equivalent circuit. In FIG. 9, bipolar transistor 61 is a planar type of PNP transistor, whose base is formed of an N-type substrate, whose emitter is formed of a P-type diffusion layer, and whose collector is formed of a P-type diffusion layer. Transistor 62 is a vertical type of NPN bipolar transistor, whose emitter is formed of an N-type diffusion layer, whose base is formed of a P-type diffusion layer, and whose collector is formed of an N-type diffusion layer. The input terminal of the protective circuit, designated as IN, is connected to one end of a polysilicon resistor 63. The other end of polysilicon resistor 63 is connected to the emitters of PNP and NPN transistors 61 and 62, and to an output terminal OUT. The collector of PNP bipolar transistor 61 is connected to the Vss potential, while the base of NPN bipolar transistor 62 is connected to the VL potential. This protective circuit is highly effective, and provides protection over a voltage range which is up to ten times that of a prior art type of protective circuit. As a result, a sufficient degree of protection is provided even if a voltage of the order of 100 V or more is produced, with a piezoelectric buzzer having a capacitance of 50 nF being utilized.

A coil 33 is used in the voltage step-up circuit 30 of FIG. 5, with one end of this coil being connected to the Vss potential and the other end connected through an external terminal 32 to the drain electrode of P-channel MOST 31 and to the source electrode of N-channel MOST 34. The source electrode and substrate of P-channel MOST 31 are connected to Vdd, while a voltage step-up signal comprising a train of pulses is applied to the gate terminal T. The gate electrode and drain electrode of N-channel MOST 34 are connected in common to capacitor 36, through external terminal 35, and also to output terminal VL. When the voltage step-up signal D goes to the low level, P-channel MOST 31 is set in the conducting state, and current flows in coil 33. When now the voltage step-up signal T goes to the Vdd level, then P-channel MOST 31 is set in the non-conducting state, and the current flowing in coil 33 is interrupted. When this occurs, a high negative-going voltage appears on external terminal 32. Since N-channel MOST 34 is connected as a diode, capacitor 36 is discharged through this diode, i.e. current flows from the positive to the negative potential.

The stepped-up voltage VL of voltage step-up circuit 30 will vary in amplitude depending upon the value of inductance of coil 33, the state of the voltage step-up signal, the conductance of P-channel MOST 31, and the size of N-channel MOST 34, etc. However it was found with one example of such a circuit that a no-load output voltage of −8 V was produced, while the output voltage under maximum load was approximately −4 V.

Figure 10:
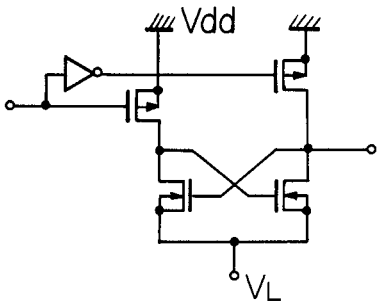
FIG. 10 is a circuit diagram of a level shifter circuit.

If a P-channel MOST 31 is to be of the same configuration as the other P-channel MOSTs in the integrated circuit chip, then it will be necessary to convert a clock signal (to be used to form the voltage step-up signal) from variation between the Vss—Vdd levels to thereby produce the voltage step-up signal varying between the Vdd—VL levels, by using a level-shifter circuit. Such level shifter circuits are commonly used in electronic timepiece circuits. FIG. 10 shows a circuit diagram of a suitable type of level-shifter circuit. Description will be omitted, since such circuits are widely known.

Figure 11:
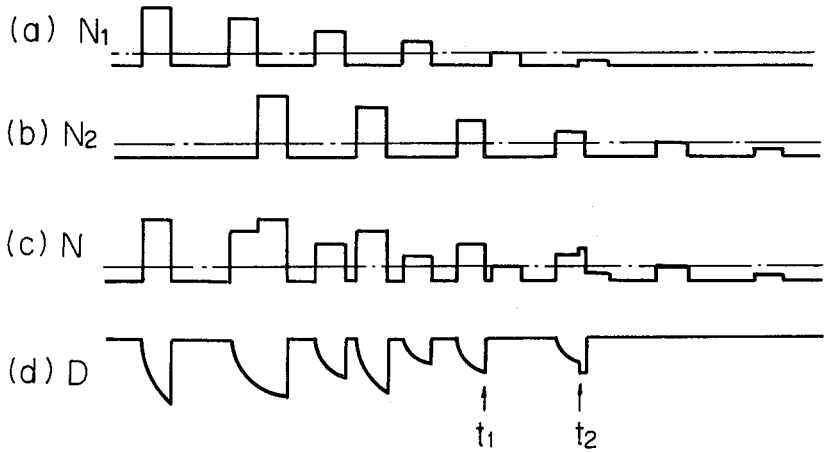
FIG. 11 is a waveform diagram for illustrating a phenomenon whereby a spurious signal component may be produced with an electro-acoustic transducer drive circuit according to the present invention.
Figure 13:
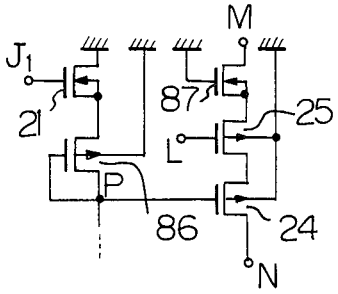
FIG. 13 is a circuit diagram of modification of the circuit of FIG. 5, for reducing circuit operation dependence upon individual transistor characteristics.

The present invention has been described in the above with reference to FIG. 5. Some additional description will be given here of the process of generating musical chords. FIGS. 11(*a*), (*b*), (*c*) and (*d*) respectively show the waveform of a signal which would appear on the common output terminal N of the envelope cells if only a first envelope cell were to be set in operation to produce a musical note, the waveform which would appear on terminal N if only a second envelope cell were to be set in operation to produce a musical note of different frequency from the first, the waveform which appears on output terminal N if both the first and second envelope cells are set in operation at the timings shown in FIGS. 11(*a*) and 13(*b*), and the resultant waveform of drive signal D applied to electro-acoustic transducer 70 resulting from the superimposed signals of FIG. 13(*c*). In FIGS. 11(*a*), (*b*) and (*c*), the chain line denotes the sensing level of sensing circuit 40. It can be seen that if the first envelope cell alone is set in operation, then the magnitude of the pulse of the output signal from that cell occurring at the point in time indicated as t1 will be below the sensing level, so that no drive signal component will result at that time. At time t2, the amplitude of a pulse of the output signal from the first envelope cell is again below the sensing level. However as shown in FIG. 13(*c*), the latter pulse occurs during a time interval which partially coincides with a pulse output from the second envelope cell, and so as a result the combined output signal produced at terminal N will be increased at time t2, producing a corresponding increase in the amplitude of the drive signal D at that time. This phenomenon causes the electro-acoustic transducer to be driven by a spurious tone signal component, resulting in distortion of the acoustic output. In order to overcome this problem, improvements to envelope cells 20A, 20B, . . . can be added with the present invention as will now be described.

Figure 12:
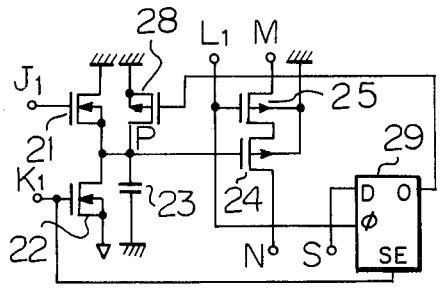
FIG. 12 is a circuit diagram of a modification to the circuit of FIG. 5, to eliminate the problem illustrated in FIG. 11.

FIG. 12 shows another embodiment of an envelope cell, to provide such improvement. Components corresponding to those in FIG. 5 are designated by identical reference numerals. Newly added components comprise a data-type flip-flop 29, and a P-channel MOST 28. The drain electrode of P-channel MOST 28 is connected to the gate terminal P, while the source electrode and substrate are connected to the Vdd potential, and the gate electrode is connected to the output terminal Q of data-type flip-flop 29. The data input terminal D of flip-flop 29 is connected to the output terminal S of level sensing circuit 40, while the tone signal input terminal L1 is connected to the positive-going clock input terminal O, and the set input terminal SE is connected to input terminal K1.

The operation of this circuit is as follows. When a sound generating signal applied to individual input terminal K1 goes to the Vdd potential, then flip-flop 29 becomes set, and output terminal Q of that flip-flop goes to the Vdd potential. This Vdd level output acts to set P-channel MOST 28 in the non-conducting state, so that gate terminal P is set at the Vss level, and P-channel MOST 24 is set fully into the conducting state. When the tone signal applied to individual input terminal L1 next goes to the Vss potential, output terminal S of level sensing circuit 40 goes to the Vdd level. Due to this, if that tone signal should go from the Vss to the Vdd level shortly thereafter, no change takes place in the logic level of the output from flip-flop 29.

After a certain time has elapsed, the potential of gate terminal P again becomes close to the Vdd level, so that the conducting resistance of P-channel MOST 24 increases. As a result, even when the tone signal goes to the Vss level, the potential of common output terminal N does not rise to a sufficiently high level to cause output terminal S of level sensing circuit 40 to change from the Vss potential. Due to this, when the tone signal next changes from the Vss to the Vdd level, the Q output of flip-flop 29 goes to the Vss level. P-channel MOST 28 is thereby set in the non-conducting state, and since gate terminal P is fully raised to the Vdd potential, N-channel MOST 24 is set into the conducting state. This condition is maintained until the tone signal applied to individual input terminal K1 again goes to the Vdd level. Thus, once it has been sensed that a tone signal has fallen below a predetermined level, determined by level sensing circuit 40, sound output resulting from that tone signal is completely inhibited until the next pulse of that tone signal is applied. In this way, the problem described above is overcome.

FIG. 13 shows an embodiment of an improved envelope cell circuit. This differs from the envelope cell of FIG. 5 or FIG. 14 in that in these previous examples the N-channel MOST 21 and P-channel MOST 24 must have almost identical values of threshold potential. However with some types of integrated circuit (depending upon the method of manufacture) this condition may be difficult to satisfy. The circuit of FIG. 13 is designed to overcome this problem by providing satisfactory operation even if these transistors have different values of threshold potential. The drain electrode of N-channel MOST 21, whose gate electrode is connected to common input terminal J1, is not directly connected to the gate terminal P, but instead is connected to gate terminal P through the intermediary of an additional P-channel MOST 86 which is connected as a diode. In addition, the source electrode of P-channel MOST 25 is not connected directly to common terminal M, but instead is connected through an additional diode-connected N-channel MOST 87 to common terminal M. The potential which gate terminal P approaches due to this, and the potential which gate terminal P attains due to the N-channel MOST entering the non-conducting state are each equal to the sum of the threshold potentials of the N-channel MOST and the P-channel MOST. As a result, manufacturing deviations in the characteristics of MOSTs 24 and 25 do not affect the circuit operation.

Figure 14A:
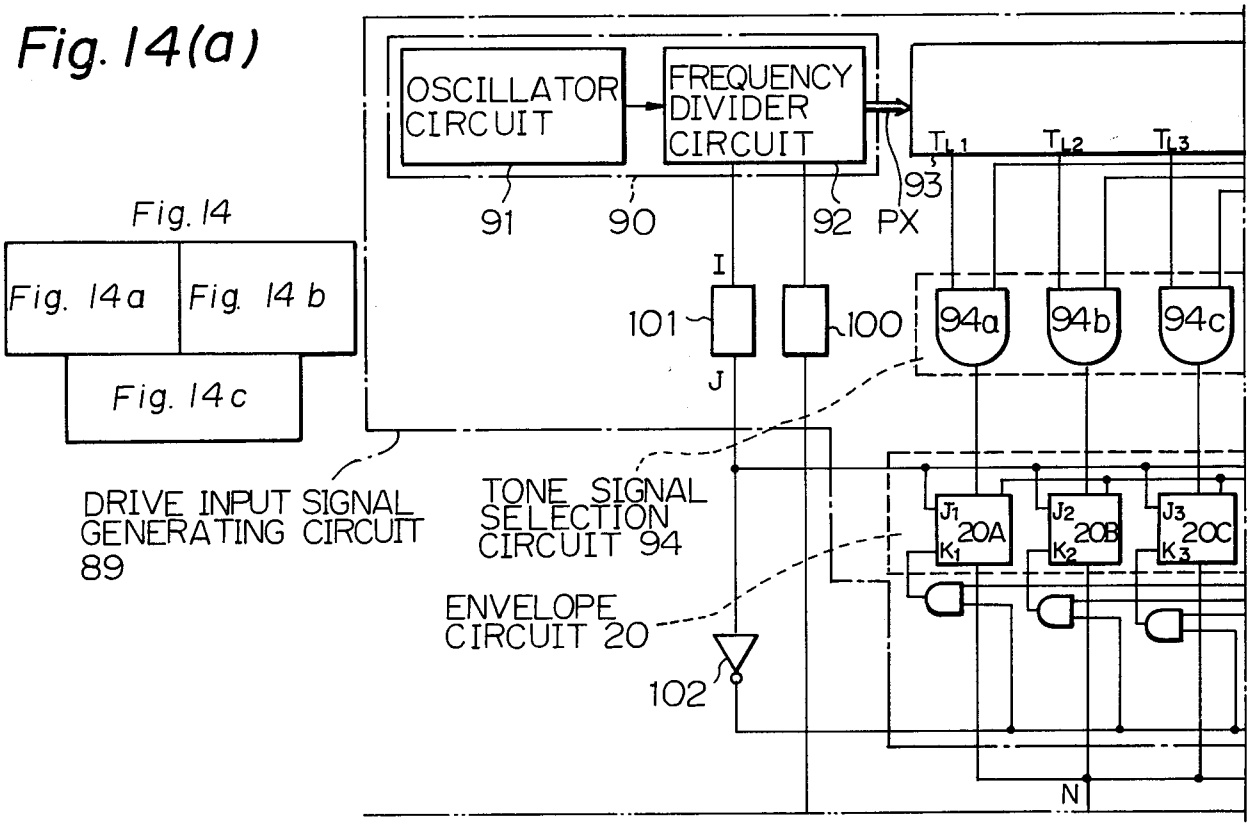
FIGS. 14(*a*), 14(*b*), and 14(*c*) are a general block circuit diagram of an electro-acoustic transducer drive circuit according to the present invention.
Figure 14B:
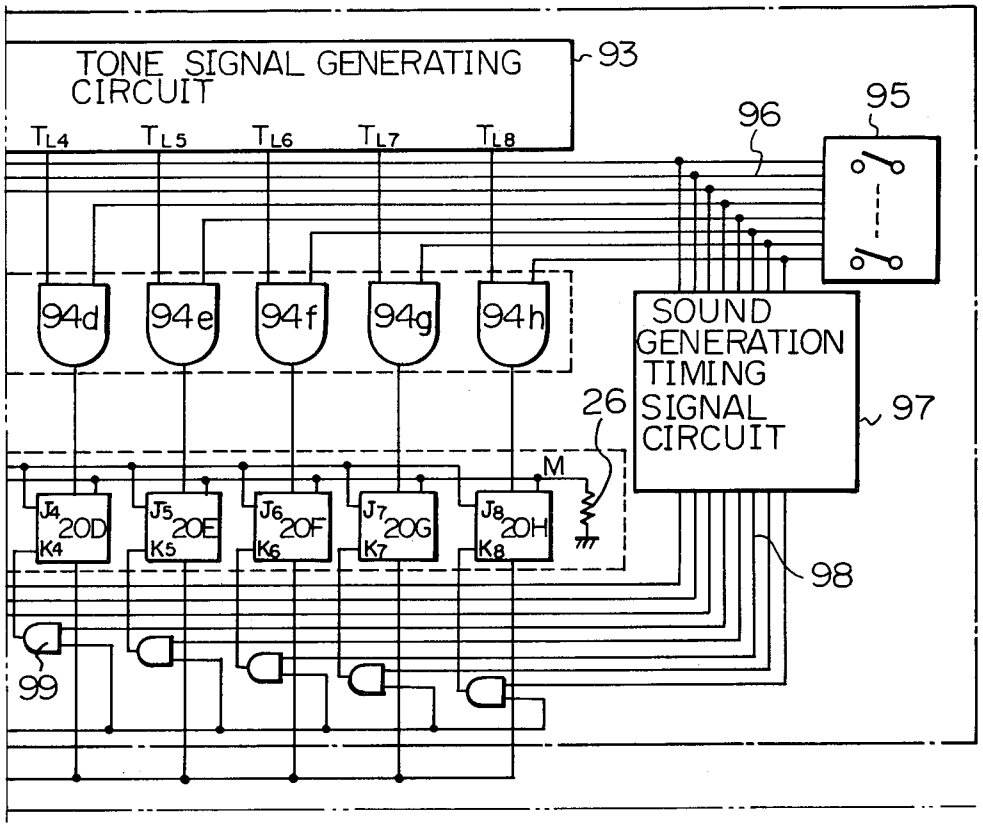
Figure 14C:
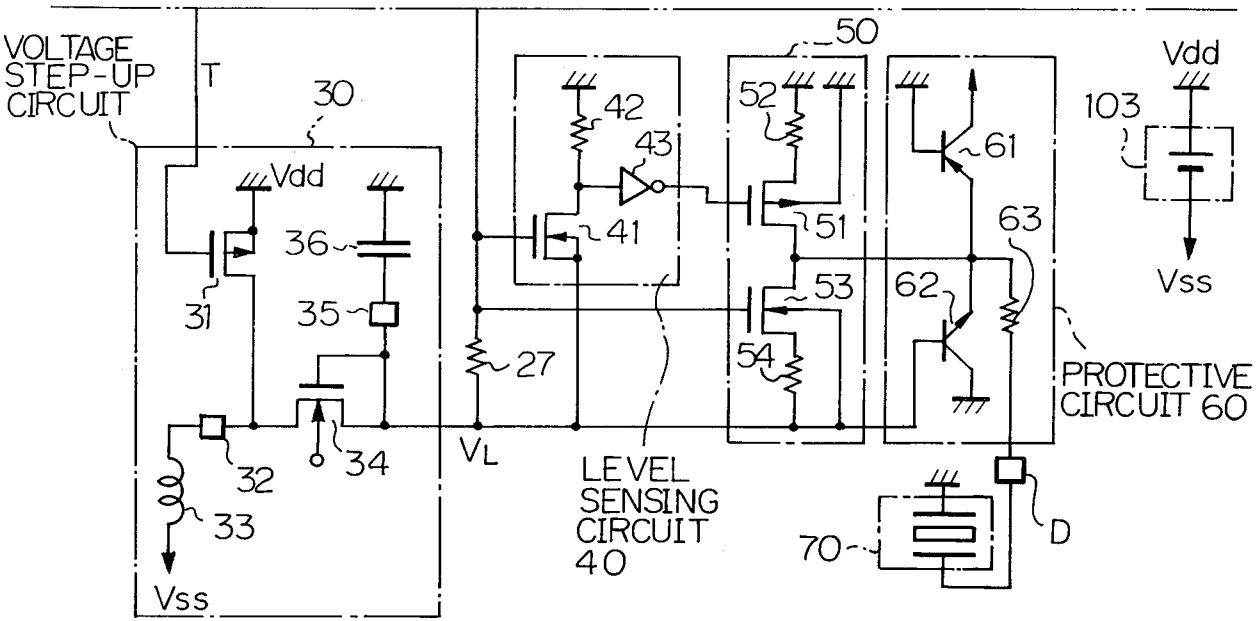

FIG. 14 is a general block circuit diagram showing the overall configuration of an electro-acoustic transducer drive circuit according to the present invention. Numeral 89 denotes a drive input signal generating circuit, for producing drive input signals which appear on common output terminal N of the set of envelope cells 20A to 20H. A timing signal generating section 90 comprises an oscillator circuit 91 for producing a time-base signal a a frequency divider circuit 92 for producing a plurality of clock signals comprising pulse trains of different frequencies. A part of these clock signals, denoted as PX, are input to a tone signal generating circuit 93, which serves to produce a plurality of tone signals having frequencies corresponding to various musical tones, as described hereinabove, which are designated as TL1 to TL6. These tone signals are applied respectively to inputs of corresponding ones of a set of AND gates 94*a* to 94*h*, in a tone signal selection circuit 94. Numeral 95 denotes note setting means, comprising for example a set of key switches to produce switching signals and circuits for producing pulses of fixed duration in respose to these switching signals, such pulses consituting selection signals which are respectively output on a set of lines 96. Each of lines 96 is coupled to a corresponding input of one of AND gates 94*a* to 94*h* in tone selection circuit 94, whereby each AND gate is enabled when a corresponding selection signal pulse is produced, causing the corresponding one of tone signals TL1 to TL8 to be transferred therethrough during a fixed time interval, to a corresponding input (L1 to L8) of the set of envelope cells 20A to 20H in envelope circuit 20. In addition, generation of a selection signal pulse on one of lines 96 results in a sound generation timing signal pulse being output on a corresponding one of a set of output lines 98 of a sound generation timing signal circuit 97, which is coupled to receive the selection signals. Such a sound generation timing signal pulses transferred through a corresponding one of a set of AND gates 99, if that gate is in the normal enabled state, and thereby transferred to a corresponding one of the input terminals K1 to K8 of envelope cells 20A to 20H.

Numeral 100 denotes a circuit for generating the voltage step-up signal described hereinabove, and can comprise a level shifter circuit coupled to receive a clock signal from timing signal generating section 90.

Numeral 101 denotes a spike waveform pulse signal generating circuit, for producing the spike waveform pulses described hereinabove. These pulses are also input to an inverter 102, whose output is coupled to an input of each of AND gates 99. It can thus be understood that transfer of a sound generation timing signal pulse (which is a positive-going pulse) to the output of any of AND gates 99 is inhibited while a spike waveform pulse is being produced. This serves to prevent a momentary short-circuit path being established across the power source, through the channels of MOSTs 21 and 22 of an envelope cell.

Numeral 103 denotes a battery serving as a power source.

As stated hereinabove, it is necessary that the spike waveform pulses applied to the envelope cells of a circuit according to the present invention be of narrow and precisely defined pulse width. This is due to the fact that the amount of discharge of capacitor 23 of an envelope cell (in FIG. 5) produced in response to each spike waveform pulse will vary in accordance with any variations in the pulse width. However prior art types of circuits for generating such pulses, which are generally of open-loop type, do not provide a sufficiently high degree of pulse width and amplitude precision, as will now be described.

Figure 15:
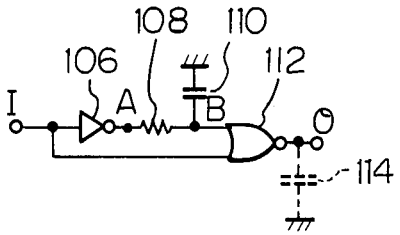
Fig. 15 PRIOR ART
FIG. 15 is a circuit diagram of a prior art type of open-loop spike waveform pulse generating circuit.

FIG. 15 is a circuit diagram of a prior art type of spike waveform pulse generating circuit. The output terminal of an inverter 106 and one input terminal of a NOR gate 112 are coupled to an input terminal I. The other input of NOR gate 112 is connected through a capacitor 110 and an input terminal D, and further is connected through a resistor 108 to the output terminal A of inverter 106. A spike waveform pulse signal appears on output terminal O of NOR gate 112.

Figure 16:
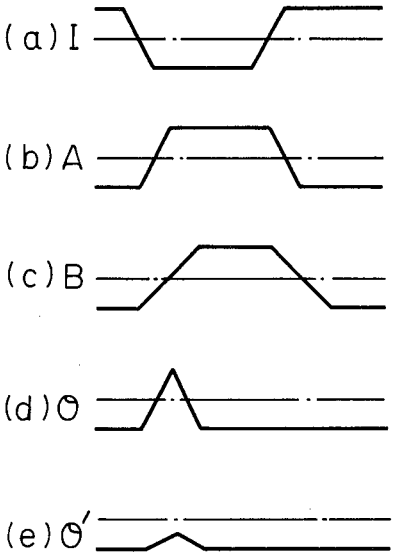
FIG. 16 is a waveform diagram for illustrating the operation of FIG. 15.

FIG. 16 is a waveform daigram for illustrating the operation of the prior art example shown in FIG. 15. When the signal applied to input terminal I falls, a spike waveform pulse is produced at output terminal O. The cahin lines in the diagram indicate the gate propogation level. In this circuit, the width of the spike waveform pulses can be adjusted by varying the values of resistor 108 and capacitor 110. If the value of load capacitance 114 applied to output terminal O is excessively large, then as indicated by O′ in FIG. 16, the peak value of the spike waveform pulse may not become sufficiently high. As a result, when circuit element value manufacturing deviations are taken into consideration, it can be understood that such a circuit cannot produce extremely narrow spike waveform pulses with a high degree of reliability.

Figure 17:
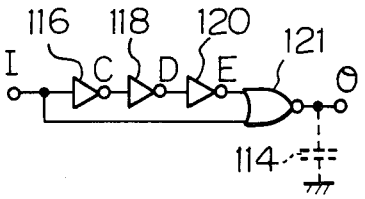
Fig. 17 PRIOR ART
FIG. 17 is a circuit diagram of another prior art type of open-loop spike waveform pulse generating circuit.
Figure 18:
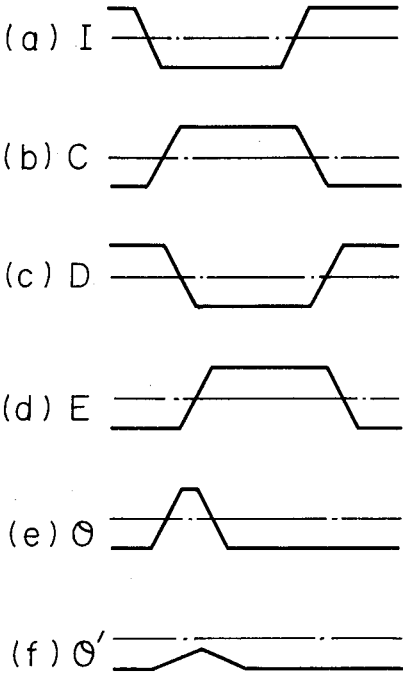
FIG. 18 is a waveform diagram for illustrating the operation of FIG. 15.

FIG. 17 shows another example of a prior art circuit. In this case, in place of the delay circuit formed of resistor 108 and capacitor 110 in the circuit of FIG. 15, the transmission delays of transistors 116, 118 and 120 are utilized. FIG. 18 shows the operating waveform of this circuit. This is also an open-loop type of circuit, so that as indicated by O′ in FIG. 18, a sufficiently high level of output signal may not be obtained, depending on the amount of load capacitance coupled to the circuit.

Figure 19:
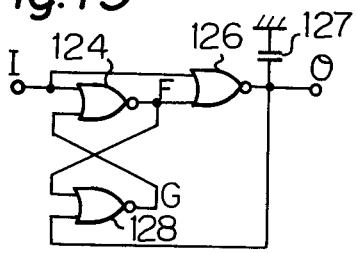
FIG. 19 is a circuit diagram of a first embodiment of a closed-loop spike waveform pulse generating circuit according to the present invention.
Figure 20:
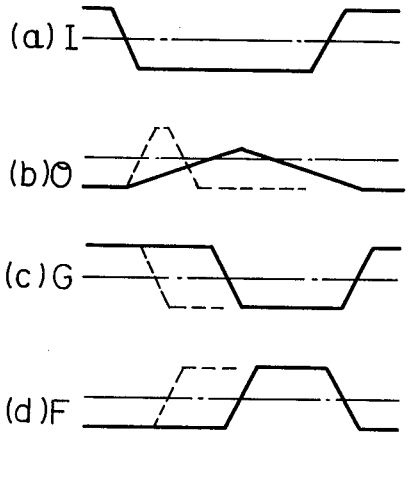
FIG. 20 is a waveform diagram for illustrating the operation of FIG. 19.

Some embodiments of spike waveform pulse generating circuits according to the present invention, designed to overcome the disadvantages of the prior art described above, will now be described. FIG. 19 is a basic circuit diagram of the present invention. One input of a NOR gate 124 is coupled to an input terminal I, together with one input terminal of another NOR gate 126. The other input terminal of a second NOR gate 126 is coupled to the output terminal F of the first NOR gate 124, and also to one input of a third NOR gate 128. The output terminal G of the third NOR gate 128 is coupled to the other input terminal of first NOR gate 124, while the output terminal Q of the second NOR gate 126 is connected to the other input terminal of third NOR gate 128, and also is connected to ground through a capacitor 127. FIG. 20 shows the operating waveforms of the circuit of FIG. 19. When the signal applied to input terminal I is at the high potential (abbreviated in the following to the H potential), then output terminal O and output terminal F go to the low potential (abbreviated in the following to the L potential), so that output terminal G goes to the H potential. When the potential of input terminal I goes from the H potential to the L potential, then output terminal O goes from the L potential to the H potential. The rise time of the latter potential transition depends upon the output resistance of NOR gate 126 and the value of capacitor 127. When the output terminal O reaches the gate propogation level of NOR gate 128, then output terminal G goes from the H potential to the L potential, so that output F goes from the L potential to the H potential. As a result, output terminal O falls towards the L potential. Due to this, a spike waveform pulse signal is produced at output terminal O, with the peak value of this signal being determined to have a minimum value which exceeds the gate propogation level of NOR gate 128. This is true, irrespective of the value of capacitor 127. Thus, the amplitude of the spike waveform pulse signal appearing at output terminal O is guaranteed to exceed the gate propogation level of NOR gate 128. The time interval for which this gate propogation level is exceeded, during each spike waveform pulse, is determined by the fall time of the potential of output terminal G, the rise time of the potential of output terminal F, and the rise time of the potential of output terminal O. In addition, the peak value of the spike waveform pulse signal appearing on output terminal O is determined by the rise time of the potential at output terminal O. If this rise time is shorter than or equal to the fall time of the potential of output terminal G and the rise time of the potential of output terminal F, then as shown by the broken-line portions of FIG. 20, the output signal appearing at terminal O will attain the maximum possible voltage level. Conversely, if the fall time and rise time of the potentials of output terminals G and F should change, then it is possible that changes will occur in the waveform of the spike waveform pulses.

Figure 21:
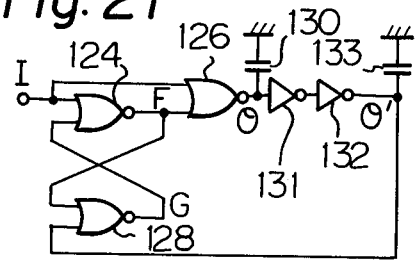
FIG. 21 is a circuit diagram of a second embodiment of a closed-loop spike waveform pulse generating circuit according to the present invention.
Figure 22:
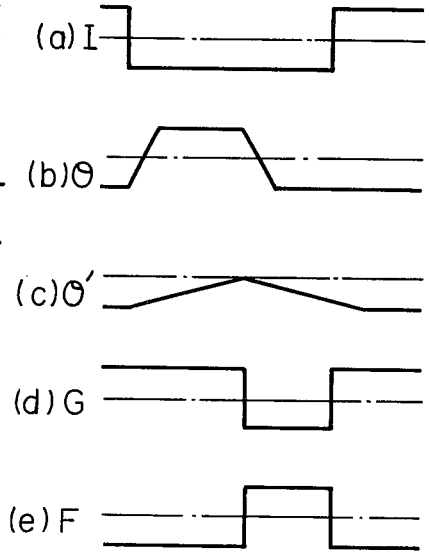
FIG. 22 is a waveform diagram for illustrating the operation of FIG. 21.

FIG. 21 is a circuit diagram of another embodiment of a spike waveform pulse generating circuit according to the present invention. This includes the feedback loop of the circuit of FIG. 20, comprising inverters 131 and 132 between output terminals O, G and F, and a delay circuit comprising capacitors 130 and 133. The operating waveforms of various points in the circuit are shown in FIG. 22. This circuit ensures that the signal appearing at output terminals O and O' will exceed at least the gate propogation level. In addition, by suitably selecting the values of capacitors 130 and 133 it is possible to produce two different spike waveform pulse signals from output terminals O and O'.

Figure 23:
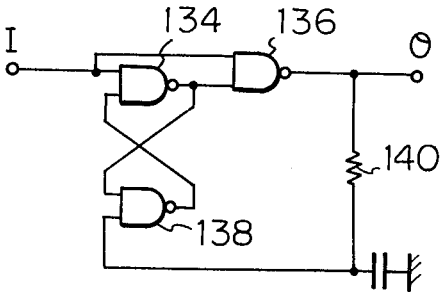
FIG. 23 is a circuit diagram of a third embodiment of a closed-loop spike waveform pulse generating circuit according to the present invention, which incorporates a temperature sensing element.

FIG. 23 is a circuit diagram of another embodiment of a spike waveform pulse generating circuit according to the present invention, which includes a temperature compensation circuit within the feedback loop. In FIG. 23, 134, 136 and 138 respectively designate NAND gates. A temperature sensing element 140 is coupled in the feedback loop, between output terminal O and NAND gate 138. Ths temperature sensing element 140 can comprise for example a thermistor, a diffused resistor, a polysilicon resistor, etc, and serves to prevent changes occurring in the spike waveform pulse signal due to to temperature variations. Alternatively, the temperature sensing element can be used to provide a desired temperature dependence for the spike waveform pulse signal. With this circuit too, it is ensured that the level of the spike waveform pulse signal will at least reach the gate propogation level.

Thus, a feedback type of spike waveform pulse generating circuit according to the present invention ensures that the peak value of a spike waveform pulse signal is at least equal to or greater than a gate propogation level. The circuit is highly effective for producing spike waveform pulses which are very narrow and of precisely defined width and amplitude.

As described in the above, the present invention enables generation of musical chords formed of separate sound waveform envelopes. Since the present invention can be implemented within an integrated circuit, it is suited to the application of various new types of technology, and is significantly advantageous with regard to cost by comparison with prior art means for providing similar functions. It can thus enable new devices to be produced at lower cost.

It is a first basic feature of the present invention that musical chords can be generated over a wide range of acoustic frequencies, while the number of external components can be made small. In particular, all of the circuit elements other than bipolar transistors used in a protective circuit can be implemented by MOS transistors within an integrated circuit. A second basic feature is that it provides a substantially more effective protective circuit. A third basic feature is that a voltage step-up circuit is incorporated, to ensure a sufficiently high level of output sound volume. A fourth basic features is that musical chords formed of separate notes can be generated, and that a novel improved type of built-in envelope generating circuit is disclosed, which enables natural-sounding damping of the acoustic output to be achieved. A fifth basic feature is that the shape of the damped waveform envelope of musical notes produced by an electroacoustic transducer driven by a circuit according to the present invention is determined by digital signals, and so can be precisely and accurately controlled.

Although the present invention has been described in the above specification with reference to specific embodiments, it should be noted that various changes and modifications to these embodiments may be envisaged, which fall within the scope claimed for the present invention as set out in the appended claims. The above specification should therefore by interpreted in a descriptive and not in a limiting sense.

What is claimed is:

1. An electro-acoustic transducer drive circuit powered by a DC power source producing at least first and second power supply potentials, for driving an electro-acoustic transducer to emit audible musical notes having a damped waveform envelope, comprising:

a voltage step-up circuit for producing a stepped-up DC potential with respect to said first power supply potential, with the potential difference between said stepped-up potential and said first power supply potential being greater than the potential difference between said first and second power supply potentials;

a drive input signal generating circuit for producing drive input signals;

a first MOS transistor for producing a drive signal to drive said electro-acoustic transducer, having the source electrode and substrate thereof connected to receive the stepped-up potential from said voltage step-up circuit and having the gate electrode coupled to receive said drive signal, and;

a protective circuit coupled between the drain electrode of first MOS transistor and the electro-acoustic transducer, to provide electrical protection for said voltage step-up circuit, said drive input signal generating circuit, and said first MOS transistor against high voltages produced by mechanical shock applied to said electro-acoustic transducer.

2. An electro-acoustic transducer drive circuit according to claim 1, in which said drive input signal generating circuit further comprises circuit means for generating a voltage step-up clock signal comprising a pulse train, and in which said voltage step-up circuit comprises a coil, a second MOS transistor having the gate electrode coupled to receive a voltage step-up clock signal, a third MOS transistor and a first capacitor, one terminal of said coil being coupled to said second power supply potential, the other terminal of said coil being coupled to the drain electrode of said second MOS transistor and the source electrode of said third MOS transistor, with the gate electrode and drain electrode of said third MOS transistor being connected to one terminal of said first capacitor and the other terminal of said first capacitor being connected in common with the source electrode and substrate of said second MOS transistor to said first power supply potential.

3. An electro-acoustic transducer drive circuit according to claim 1, in which said protective circuit comprises a PNP bipolar transistor, an NPN bipolar transistor and a resistor, said PNP bipolar transistor having the emitter thereof connected in common to the emitter of said NPN bipolar transistor to receive said drive input signal, the base thereof connected to said first power supply potential and the collector thereof connected to said second power supply potential, the collector of said NPN bipolar transistor being connected to said first power supply potential, the base connected to said second power supply potential and said resistor being connected between said electro-acoustic transducer and the emitters of said PNP and NPN transistors.

4. An electro-acoustic transducer drive circuit according to claim 1, in which said drive input signal generating circuit comprises;

a clock signal generating circuit for producing a clock signal comprising a pulse train;

tone signal generating circuit means coupled to receive said clock signal and responsive thereto for producing a plurality of tone signals comprising pulse trains of different frequencies;

note setting means for producing selection signals to be used to select arbitrary ones of said plurality of tone signals during fixed time intervals;

a selection circuit coupled to receive said selection signals and responsive thereto for selecting tone signals from among said plurality of tone signals to be output therefrom in accordance with said selection signals, each selected tone signal being output therefrom during a predetermined interval of duration determined by said selection signals;

an envelope generating circuit for converting said tone signals selected by said selection circuit to signals having a damped waveform envelope and for outputting said damped waveform envelope signal as said drive input signal;

a sound generation timing signal circuit for producing sound generation timing signals to control the initiation of operation by said envelope generating circuit in accordance with said selection signals, and;

a spike waveform pulse generating circuit responsive to said clock signal from said clock signal generating circuit for producing a spike waveform pulse signal to control the damping operation of said envelope generating circuit, said spike waveform pulse signal comprising a train of pulses of narrow pulse width.

5. An electro-acoustic transducer drive circuit according to claim 4, in which said envelope generating circuit comprises a plurality of envelope cells, with the output terminals of each of said envelope cells being connected in common, whereby said drive input signal is output therefrom.

6. An electro-acoustic transducer drive circuit according to claim 5, in which each of said envelope cells comprises at least a fourth, fifth, sixth and seventh MOS transistor, and a second capacitor, with the drain electrode of said fourth MOS transistor being connected to said first power supply potential, the source electrode and substrate of said fourth MOS transistor being connected in common with the drain electrode of said fifth MOS transistor to one terminal of said second capacitor and to the gate electrode of said sixth MOS transistor, the gate electrode of said fifth MOS transistor being connected to receive said sound generation timing signals and being responsive thereto for charging said second capacitor, the gate electrode of said fourth MOS transistor being coupled to receive said spike waveform pulse signal and being responsive to successive pulses thereof for sequentially discharging said second capacitor, the gate electrode of said seventh MOS transistor being coupled to receive said drive input signal, the channel of said seventh MOS transistor and that of said sixth MOS transistor being connected in series to form a series circuit, one end of said series circuit being connected to the said first power supply potential and the remaining end constituting an output terminal of said envelope cell and being connected through a resistor to said stepped-up potential of said voltage step-up circuit.

7. An electro-acoustic transducer drive circuit according to claim 4, in which said spike waveform pulse generating circuit comprises a flip-flop coupled to receive said clock signal at one input terminal thereof, a gate circuit coupled to receive said clock signal and an output signal from said flip-flop, a capacitor connected between the output terminal of said gate circuit and said first power supply potential, with the output signal from said gate circuit being connected to another input terminal of said flip-flop to thereby form a feedback loop.

8. An electro-acoustic transducer drive circuit according to claim 4, in which said spike waveform pulse generating circuit comprises a flip-flop coupled to receive said clock signal at one input terminal thereof, a gate circuit coupled to receive said clock signal and an output signal from said flip-flop as input signals, a third capacitor coupled between the output terminal of said gate circuit and said first power supply potential, a delay circuit coupled to the output terminal of said gate circuit, with the output signal from said delay circuit being coupled to another input terminal of saud flip-flop to thereby form a feeback loop.

9. An electro-acoustic transducer drive circuit according to claim 4, in which said spike waveform pulse generating circuit comprises a flip-flop having one input terminal coupled to receive said clock signal, a gate circuit coupled to receive said clock signal and an output signal from said flip-flop, a temperature sensitive resistor connected to the output terminal of said gate circuit, and a capacitor connected through said temperature sensitive resistor to the first power supply potential.

10. An electro-acoustic transducer drive circuit powered by a DC power source producing at least first and second power supply potentials, for driving an electro-acoustic transducer to emit audible musical notes having a damped waveform envelope, comprising:

a voltage step-up circuit for producing a stepped-up DC potential with respect to said first power supply potential, with the potential difference between said stepped-up potential and said first power supply potential being greater than that the potential difference between said first and second power supply potentials;

a drive input signal generating circuit for producing drive input signals;

a first MOS transistor for producing a drive signal to drive said electro-acoustic transducer, having the source electrode and substrate thereof connected to receive the stepped-up potential from said voltage step-up circuit and having the gate electrode coupled to receive said drive signal, and;

a protective circuit coupled between the drain electrode of first MOS transistor and the electro-acoustic transducer, to provide electrical protection for said voltage step-up circuit, said drive input signal generating circuit, and said first MOS transistor against high voltages produced by mechanical shock applied to said electro-acoustic transducer, and;

an eighth MOS transistor having the drain electrode coupled in common with the drain electrode of said first MOS transistor and the source electrode and substrate connected to said first power supply potential, a level sensing circuit for sensing the level of said drive input signal, with the input terminal of said level sensing circuit being connected in common with the gate electrode of said first MOS transistor and the output terminal of said level sensing circuit being connected to the gate electrode of said eighth MOS transistor.

11. An electro-acoustic transducer drive circuit according to claim 10, in which said drive input signal generating circuit comprises;

a clock signal generating circuit for producing a clock signal comprising a pulse train;

tone signal generating circuit means coupled to receive said clock signal and responsive thereto for producing a plurality of tone signals comprising pulse trains of different frequencies;

note setting means for producing selection signals to be used to select arbitrary ones of a plurality of tone signals;

a selection circuit coupled to receive said selection signals and responsive thereto for selecting tone signals from among said plurality of tone signals to be output therefrom in accordance with said selection signals, each being output therefrom during a fixed time interval of duration determined by said selection signals;

an envelope generating circuit for converting said tone signals selected by said selection circuit to signals having a damped waveform envelope and for outputting said damped waveform envelope signal as said drive input signal;

a sound generation timing signal circuit for producing sound generation timing signals to control the initiation of operation by said envelope generating circuit in accordance with said selection signals, and;

a spike waveform pulse generating circuit responsive to said clock signal from said clock signal generating circuit for producing a spike waveform pulse signal to control the damping operation of said envelope generating circuit, said spike waveform pulse signal comprising a train of pulses of narrow pulse width.

12. An electro-acoustic transducer drive circuit according to 11 in which said envelope generating circuit comprises a plurality of envelope cells, with the output terminals of each of said envelope cells being connected in common.

13. An electro-acoustic transducer drive circuit according to claim 12, in which each of said envelope cells comprises at least a fourth, fifth, sixth, seventh and eighth MOS transistor, a second capacitor and a flip-flop, with the drain electrode of said fourth MOS transistor being connected to said first power supply potential, the source electrode and substrate of said fourth MOS transistor being connected in common with the drain electrode of said fifth MOS transistor to one terminal of said second capacitor and to the gate electrode of said sixth MOS transistor, the gate electrode of said fifth MOS transistor being connected to receive said sound generation timing signals and being responsive thereto for charging said second capacitor, the gate electrode of said fourth MOS transistor being coupled to receive said spike waveform pulse signal and being responsive to successive pulses thereof for sequentially discharging said second capacitor, the gate electrode of said seventh MOS transistor being coupled to receive said drive input signal, the channel of said seventh MOS transistor and that of said sixth MOS transistor being connected in series to form a series circuit, one end of said series circuit being connected to the said first power supply potential and the remaining end constituting an output terminal of said envelope cell and being connected through a resistor to said stepped-up potential of said voltage step-up circuit, said flip-flop being set by said sound generation timing signal and being reset by an output signal from said level sensing circuit, with the output of said flip-flop being coupled to the gate electrode of said eighth MOS transistor which is responsive thereto for discharging said capacitor while said flip-flop is in the reset state, with the channel of said eighth MOS transistor being connected in parallel with said second capacitor.

14. An electro-acoustic transducer drive circuit according to claim 12, in which each of said envelope cells comprises at least a fourth, fifth and sixth MOS transistor, a second capacitor, and first and second diodes, and in which the drain electrode of said fourth MOS transistor is connected to said first power supply potential, and the source electrode and substrate of said fourth MOS transistor are coupled in common to the drain electrode of said fifth MOS transistor and to one terminal of said second capacitor and also to the gate electrode of said sixth MOS transistor, said sound generation timing signal being applied to the gate electrode of said fifth MOS transistor which is responsive thereto for charging said second capacitor, said spike waveform pulse signal being applied to the gate electrode of said fourth MOS transistor which acts to sequentially discharge said second capacitor in response to successive pulses of said spike waveform pulse signal, said tone signal being applied to the gate electrode of said seventh MOS transistor, the channel of said seventh MOS transistor and that of said sixth MOS transistor being connected in series to form a series circuit, with one end of said series circuit being connected to said first power supply potential and the other end constituting an envelope output terminal, and further comprising a resistor, with said other end of said series circuit being connected through said resistor to the stepped-up potential of said voltage step-up circuit, said first diode being connected in series with the channel of said fourth MOS transistor and said second diode being connected in series with the channel of said seventh MOS transistor.

15. An electro-acoustic transducer drive circuit according to claim 14, in which said first and second diode are each formed of MOS transistors.

* * * * *